US011104124B2

(12) United States Patent
Nakano

(10) Patent No.: US 11,104,124 B2
(45) Date of Patent: Aug. 31, 2021

(54) INTEGRATED CIRCUIT APPARATUS AND LIQUID DISCHARGE APPARATUS

(71) Applicant: SEIKO EPSON CORPORATION, Tokyo (JP)

(72) Inventor: Shuichi Nakano, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/752,803

(22) Filed: Jan. 27, 2020

(65) Prior Publication Data

US 2020/0238691 A1 Jul. 30, 2020

(30) Foreign Application Priority Data

Jan. 29, 2019 (JP) ..... JP2019-012829

(51) Int. Cl.
*B41J 2/045* (2006.01)
*B41J 2/07* (2006.01)

(52) U.S. Cl.
CPC ..... *B41J 2/04541* (2013.01); *B41J 2/07* (2013.01); *B41J 2/04596* (2013.01)

(58) Field of Classification Search
CPC ..... B41J 2/04541; B41J 2/07; B41J 2/04501
See application file for complete search history.

(56) References Cited

U.S. PATENT DOCUMENTS

2007/0222807 A1* 9/2007 Silverbrook ..... B41J 2/1646 347/17
2008/0143809 A1* 6/2008 Tanaka ..... B41J 2/0454 347/194
2013/0215177 A1 8/2013 Sugita
2019/0009527 A1 1/2019 Yamada et al.

FOREIGN PATENT DOCUMENTS

CN 108472949 A 8/2018
JP 2013-169750 A 9/2013
JP 2016074227 A * 5/2016

OTHER PUBLICATIONS

English Translation (Description) of JP-2016074227A , Sugita Hiroshi, May 2016.*

* cited by examiner

*Primary Examiner* — Sharon Polk
(74) *Attorney, Agent, or Firm* — Global IP Counselors, LLP

(57) ABSTRACT

An integrated circuit apparatus used in a liquid discharge apparatus includes a print head and a positional information signal output circuit which outputs a positional information signal indicating positional information of the print head. The integrated circuit apparatus includes a memory circuit configured to store print width restriction information which specifies a print available range of the print head, a base driving signal generation circuit configured to output a base driving signal which is a base of the driving signal, and a discharge control signal generation circuit configured to output a discharge control signal which controls supply of the driving signal to the driving element. Output of at least one of the base driving signal and the discharge control signal is restricted based on the print width restriction information.

6 Claims, 12 Drawing Sheets

| [SIH, SIL] | | [1, 1] | [1, 0] | [0, 1] | [0, 0] |
|---|---|---|---|---|---|
| S | T1 | H | H | L | L |
| | T2 | H | L | H | L |
| | T3 | L | L | L | H |

INTEGRATED CIRCUIT APPARATUS AND LIQUID DISCHARGE APPARATUS

The present application is based on, and claims priority from JP Application Serial Number 2019-012829, filed Jan. 29, 2019, the disclosure of which is hereby incorporated by reference herein in its entirety.

BACKGROUND

1. Technical Field

The present disclosure relates to an integrated circuit apparatus and a liquid discharge apparatus.

2. Related Art

As an example of a liquid discharge apparatus, print apparatuses which form a desired image on a medium by discharging ink from nozzles have been used. Such a print apparatus includes a print head having a plurality of nozzles and driving elements corresponding to the nozzles. Then the print head reciprocates in a main scanning direction which intersects with a medium transport direction and the driving elements are driven based on a driving signal supplied to the print head so that ink is discharged from the corresponding nozzles. By this, the ink is discharged in desired positions of the medium.

In such a print apparatus, a print range in which the ink is discharged from the print head may be restricted in accordance with a movement range of the print head, a size of the medium to which the ink is discharged, an operation state of the print head, and the like.

JP-A-2013-169750 discloses a technique of restricting discharge of ink when a counter included in a print head counts the number of signals which specify a discharge cycle and the number of signals exceeds a threshold value set based on heat restriction of the head controller, for example.

However, the ink discharge restriction in the print apparatus disclosed in JP-A-2013-169750 is controlled by the head controller disposed in the print head. Therefore, even after the ink discharge restriction is set, various control signals including the driving signal are continuously input to the print head. Accordingly, the print apparatus disclosed in JP-A-2013-169750 is not sufficient in terms of power consumption and heat generation and has room to improve power consumption and heat generation of the print head at the time of the discharge restriction.

SUMMARY

According to an aspect of the present disclosure, an integrated circuit apparatus used in a liquid discharge apparatus includes a print head which reciprocates in a main scanning direction and which discharges liquid when a driving element is driven based on a driving signal and a positional information signal output circuit which outputs a positional information signal indicating positional information of the print head. The integrated circuit apparatus includes a memory circuit configured to store print width restriction information which specifies a print available range of the print head, a base driving signal generation circuit configured to output a base driving signal which is a base of the driving signal, and a discharge control signal generation circuit configured to output a discharge control signal which controls supply of the driving signal to the driving element. Output of at least one of the base driving signal and the discharge control signal is restricted based on the print width restriction information.

The integrated circuit apparatus according to the present disclosure may further include a timing control circuit configured to specify a generation timing of at least one of the base driving signal and the discharge control signal based on the positional information signal. The timing control circuit may restrict output of at least one of the base driving signal and the discharge control signal based on the print width restriction information and the positional information signal.

The integrated circuit apparatus according to the present disclosure may further include a calculation processing circuit configured to output a print width information signal including print width information which specifies a print available range of the print head. The timing control circuit may restrict output of at least one of the base driving signal and the discharge control signal based on the print width restriction information, the print width information, and the positional information signal.

In the integrated circuit apparatus according to the present disclosure, the timing control circuit may output an error signal indicating that the print width information has an error when a difference between a value specified by the print width restriction information and a value specified by the print width information is not less than a predetermined value.

In the integrated circuit apparatus according to the present disclosure, the timing control circuit may include a driving timing control circuit which specifies a generation timing of the base driving signal. The driving timing control circuit may restrict output of the base driving signal based on the print width restriction information and the positional information signal.

In the integrated circuit apparatus according to the present disclosure, the timing control circuit may include a discharge timing control circuit which specifies a generation timing of the discharge control signal. The discharge timing control circuit may restrict output of the discharge control signal based on the print width restriction information and the positional information signal.

According to another aspect of the present disclosure, a liquid discharge apparatus includes a print head configured to reciprocate in a main scanning direction and discharge liquid when a driving element is driven based on a driving signal, a positional information signal output circuit configured to output a positional information signal indicating positional information of the print head, and an integrated circuit apparatus including a memory circuit configured to store print width restriction information which specifies a print available range of the print head, a base driving signal generation circuit configured to output a base driving signal which is a base of the driving signal, and a discharge control signal generation circuit configured to output a discharge control signal which controls supply of the driving signal to the driving element. Output of at least one of the base driving signal and the discharge control signal is restricted based on the print width restriction information.

DESCRIPTION OF EXEMPLARY EMBODIMENTS

Hereinafter, a preferred embodiment of the present disclosure will be described with reference to the accompanying drawings. The drawings used herein are merely for explanatory convenience. Note that the embodiment below does not unduly restrict content of the present disclosure described in claims. Furthermore, it is not necessarily the case that all the configurations described below are requirements of the present disclosure.

1. Configuration of Liquid Discharge Apparatus

A print apparatus 1 which is an example of a liquid discharge apparatus according to this embodiment is an ink jet printer which forms dots on a print medium, such as paper, by discharging ink in accordance with image data externally supplied from a host computer so as to print an image including text and diagrams corresponding to the image data.

Figure 1:
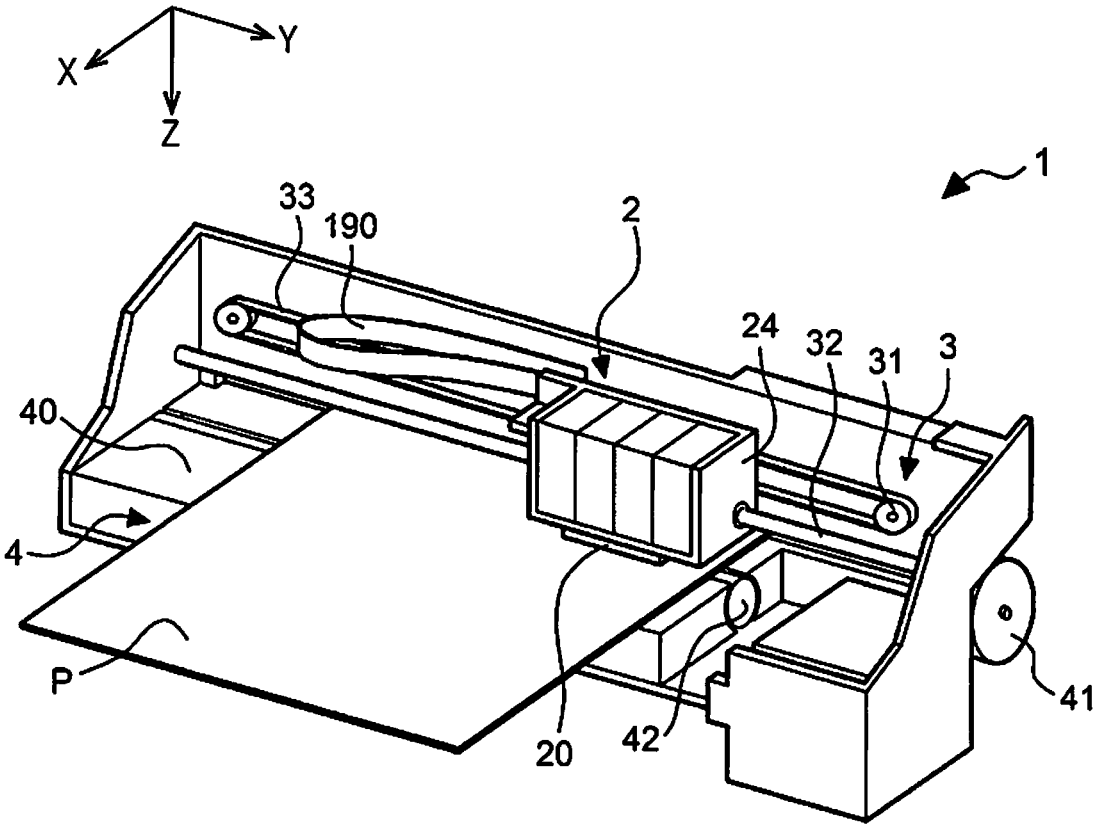
FIG. 1 is a perspective view schematically illustrating a configuration of a print apparatus.

FIG. 1 is a perspective view schematically illustrating a configuration of the print apparatus 1. In FIG. 1, a direction in which a medium P is transported is denoted by X, a direction in which a mobile body 2 reciprocates is denoted by Y, and a direction in which the ink is discharged is denoted by Z. The X and Y directions intersect with each other. Note that, although the X, Y, and Z directions are orthogonal to each other in this embodiment, components included in the print apparatus 1 may not be arranged in an orthogonal manner. Here, the Y direction in which the mobile body 2 moves is referred to as a main scanning direction where appropriate.

As illustrated in FIG. 1, the print apparatus 1 includes the mobile body 2 and a movement mechanism 3 which causes the mobile body 2 to reciprocate in the Y direction. The movement mechanism 3 includes a carriage motor 31 serving as a driving source of the mobile body 2, a carriage guide shaft 32 having fixed opposite ends, and a timing belt 33 which extends substantially in parallel to the carriage guide shaft 32 and which is driven by the carriage motor 31.

A carriage 24 included in the mobile body 2 is supported by the carriage guide shaft 32 in a reciprocation available manner and fixed in a portion of the timing belt 33. When the timing belt 33 is driven by the carriage motor 31, the carriage 24 reciprocates in the Y direction while being guided by the carriage guide shaft 32. Furthermore, a portion of the mobile body 2 which faces the medium P has a print head 20 including a large number of nozzles. Various signals and the like are supplied to the print head 20 through a cable 190. The print head 20 discharges ink, which is an example of liquid, from the nozzles based on the supplied various signals.

The print apparatus 1 includes a transport mechanism 4 which transports the medium P on a platen 40 in the X direction. The transport mechanism 4 includes a transport motor 41 which is a driving source and a transport roller 42 which is rotated by the transport motor 41 so as to transport the medium P in the X direction. Then the print head 20 discharges ink when the medium P is transported by the transport mechanism 4 so that an image is formed on a surface of the medium P.

Figure 2:
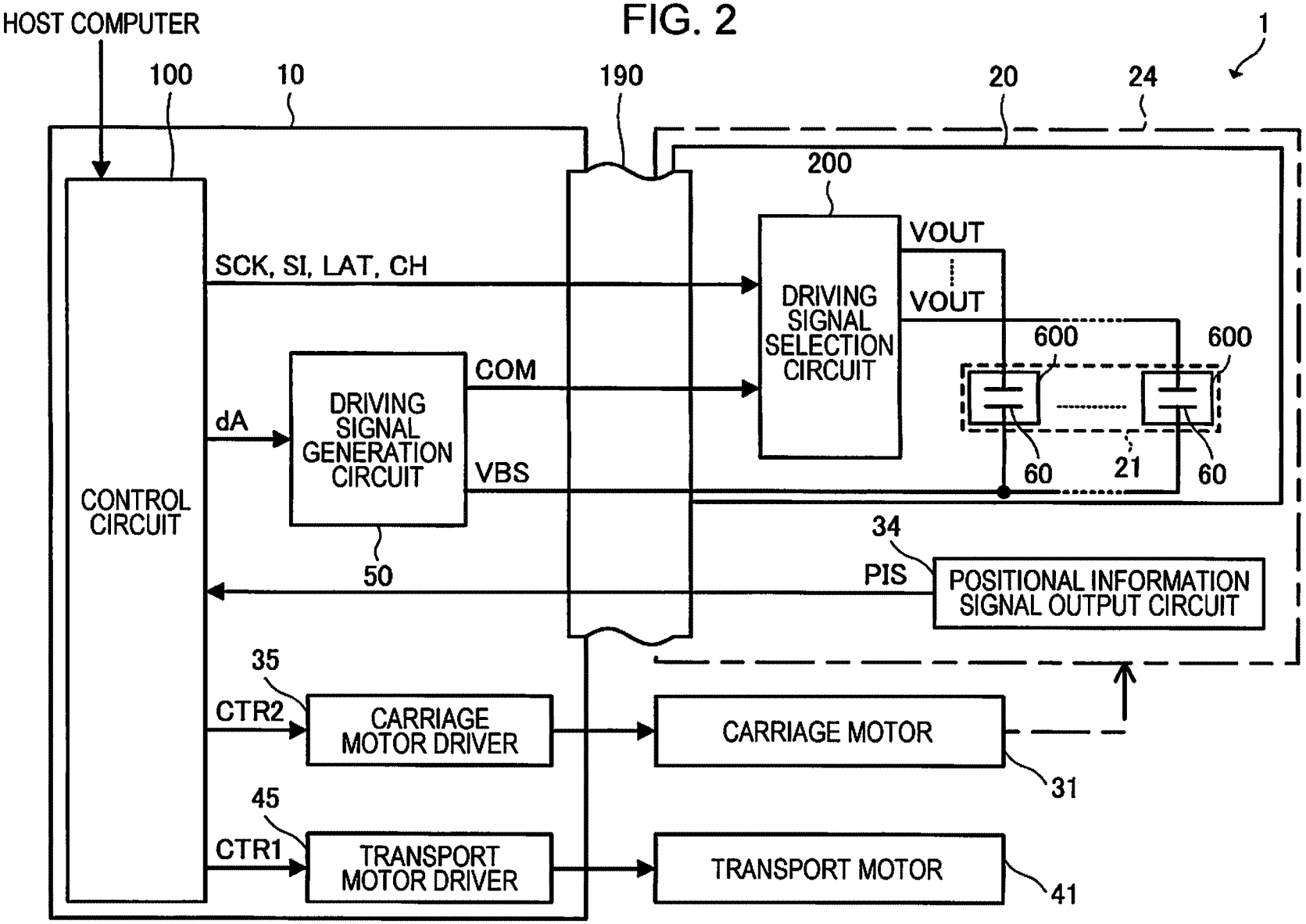
FIG. 2 is a block diagram illustrating an electric configuration of the print apparatus.

FIG. 2 is a block diagram illustrating an electric configuration of the print apparatus 1. As illustrated in FIG. 2, the print apparatus 1 includes a print head control circuit 10, the carriage motor 31, the transport motor 41, the print head 20, and a positional information signal output circuit 34. Among these components, the print head 20 and the positional information signal output circuit 34 are mounted on the carriage 24. The components mounted on the carriage 24 and the print head control circuit 10 are electrically coupled to each other through the cable 190, such as a flexible flat cable (FFC).

The print head control circuit 10 includes a control circuit 100, a carriage motor driver 35, a transport motor driver 45, and a driving signal generation circuit 50.

The control circuit 100 outputs various signals for controlling the print head 20. Specifically, the control circuit 100 outputs a control signal CTR1 to the transport motor driver 45. The transport motor driver 45 controls driving of the transport motor 41 in accordance with the supplied control signal CTR1. By this, the transport mechanism 4 controls a movement of the medium P in the X direction as described above.

Furthermore, the control circuit 100 outputs a control signal CTR2 to the carriage motor driver 35. The carriage motor driver 35 controls driving of the carriage motor 31 in accordance with the supplied control signal CTR2. By this, the movement of the carriage 24 in the Y direction described above is controlled. In this case, the positional information signal output circuit 34 detects a position of the carriage 24. Then the positional information signal output circuit 34 outputs a position of the carriage 24 in the Y direction to the control circuit 100 as a positional information signal PIS.

Furthermore, the control circuit 100 outputs a base driving signal dA of a digital signal to the driving signal generation circuit 50. The driving signal generation circuit 50 performs digital/analog signal conversion on the input base driving signal dA and performs class D amplification on the converted analog signal so as to generate a driving signal COM. Note that the base driving signal dA at least specifies a signal wave of the driving signal COM and is may be an analog signal. Furthermore, the driving signal generation circuit 50 at least amplifies the signal wave specified by the base driving signal dA and includes a class A amplifier circuit, a class B amplifier circuit, a class AB amplifier circuit.

Furthermore, the driving signal generation circuit 50 generates a reference voltage signal VBS indicating a reference potential of the driving signal COM. The reference voltage signal VBS may be a signal of a ground potential having a voltage value of 0V or a signal of a direct current voltage having a voltage value of 6V or so.

Furthermore, the control circuit 100 outputs a clock signal SCK, a print data signal SI, a latch signal LAT, and a change signal CH to the print head 20. Here, the control circuit 100 generates the latch signal LAT and the change signal CH based on the positional information signal PIS indicating a position of the carriage 24.

The control circuit 100 described above is configured as an integrated circuit (IC). The control circuit 100 configured as an integrated circuit is an example of an integrated circuit apparatus.

The print head 20 includes a driving signal selection circuit 200 and a discharge head 21.

The driving signal selection circuit 200 receives the clock signal SCK, the print data signal SI, the latch signal LAT, the change signal CH, and the driving signal COM. The driving signal selection circuit 200 selects or does not select a signal wave included in the driving signal COM based on the clock signal SCK, the print data signal SI, the latch signal LAT, and the change signal CH. Then the driving signal selection circuit 200 outputs the selected signal waveform to the discharge head 21 as a driving signal VOUT.

The discharge head 21 includes a plurality of discharge sections 600 and a plurality of piezoelectric elements 60 corresponding to the discharge sections 600. The driving signal VOUT and the reference voltage signal VBS are supplied to each of the piezoelectric elements 60. Each of the piezoelectric elements 60 is driven in accordance with a potential difference between the driving signal VOUT and the reference voltage signal VBS. By this, a certain amount of ink is discharged from the discharge sections 600.

As described above, the print apparatus 1 reciprocates in the Y direction which is the main scanning direction and includes the print head 20 which discharges ink when being driven by the piezoelectric elements 60 based on the driving signal COM and the positional information signal output circuit 34 which outputs the positional information signal PIS indicating positional information of the print head 20.

2. Configuration and Operation of Driving Signal Selection Control Circuit

Next, a configuration and an operation of the driving signal selection circuit 200 will be described. First, an example of the driving signal COM supplied to the driving signal selection circuit 200 will be described with reference to FIG. 3. Thereafter, a configuration and an operation of the driving signal selection circuit 200 will be described with reference to FIGS. 4 to 7.

Figure 3:
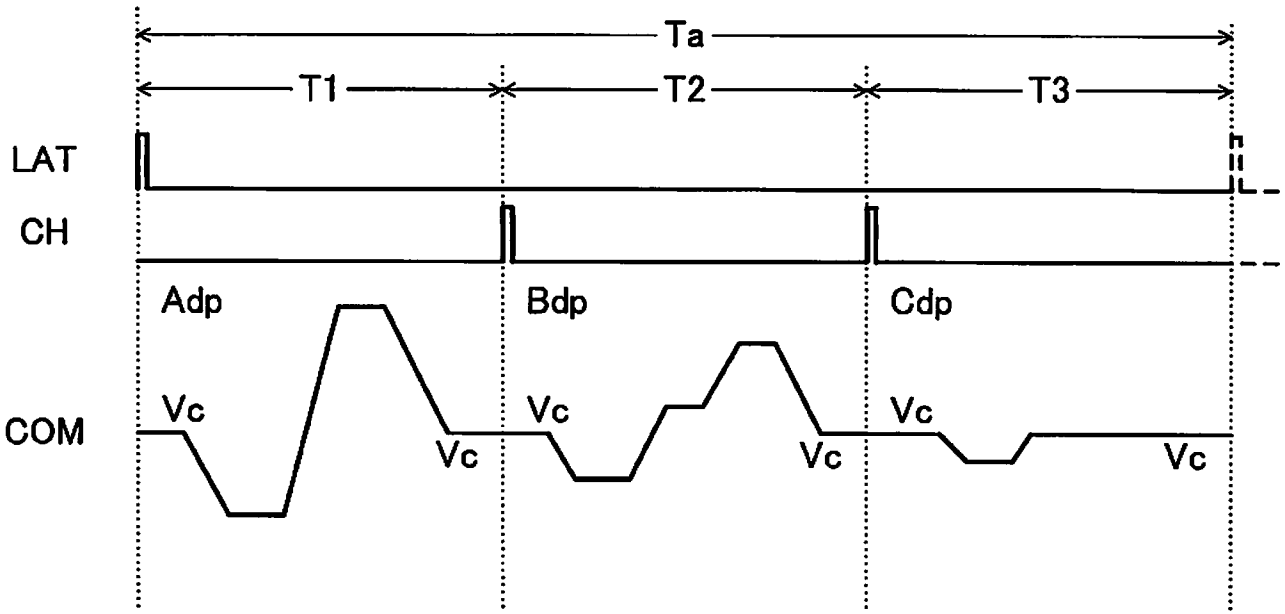
FIG. 3 is a diagram illustrating an example of a driving signal COM.

FIG. 3 is a diagram illustrating an example of the driving signal COM. In FIG. 3, a period T1 from when the latch signal LAT rises to when the change signal CH rises, a period T2 from when the period T1 is terminated to when the change signal CH rises again, and a period T3 from when the period T2 is terminated to when the latch signal LAT rises again are illustrated. Note that dots are newly formed on the medium P in a cycle Ta including the periods T1, T2, and T3.

As illustrated in FIG. 3, the driving signal generation circuit 50 generates a trapezoidal waveform Adp in the period T1. When the trapezoidal waveform Adp is supplied to the piezoelectric elements 60, a certain amount of ink, specifically, a middle amount of ink is discharged from the corresponding discharge sections 600. Furthermore, the driving signal generation circuit 50 generates a trapezoidal waveform Bdp in the period T2. When the trapezoidal waveform Bdp is supplied to the piezoelectric elements 60, a small amount of ink which is smaller than the certain amount of ink described above is discharged from the corresponding discharge sections 600. Furthermore, the driving signal generation circuit 50 generates a trapezoidal waveform Cdp in the period T3. When the trapezoidal waveform Cdp is supplied to the piezoelectric elements 60, the piezoelectric elements 60 are displaced in a degree that ink is not discharged from the corresponding discharge sections 600. Accordingly, dots are not formed on the medium P. The trapezoidal waveform Cdp is a signal waveform which suppresses increase in viscosity of the ink by generating micro vibration on the ink in the vicinity of nozzle opening sections of the discharge sections 600. In a description below, an operation of displacing the piezoelectric elements 60 in the degree that ink is not discharged from the discharge sections 600 so that increase in viscosity of the ink is suppressed is referred to as "micro vibration".

Here, voltage values obtained at start timings of the trapezoidal waveforms Adp, Bdp, and Cdp and voltage values obtained at end timings of the trapezoidal waveforms Adp, Bdp, and Cdp are all a voltage Vc. Specifically, the trapezoidal waveforms Adp, Bdp, and Cdp are signal waveforms started and terminated at the voltage value of the voltage Vc. Accordingly, the driving signal COM generated by the driving signal generation circuit 50 includes the signal wave including the trapezoidal waveforms Adp, Bdp, and Cdp consecutively appear in the period Ta.

Figure 4:
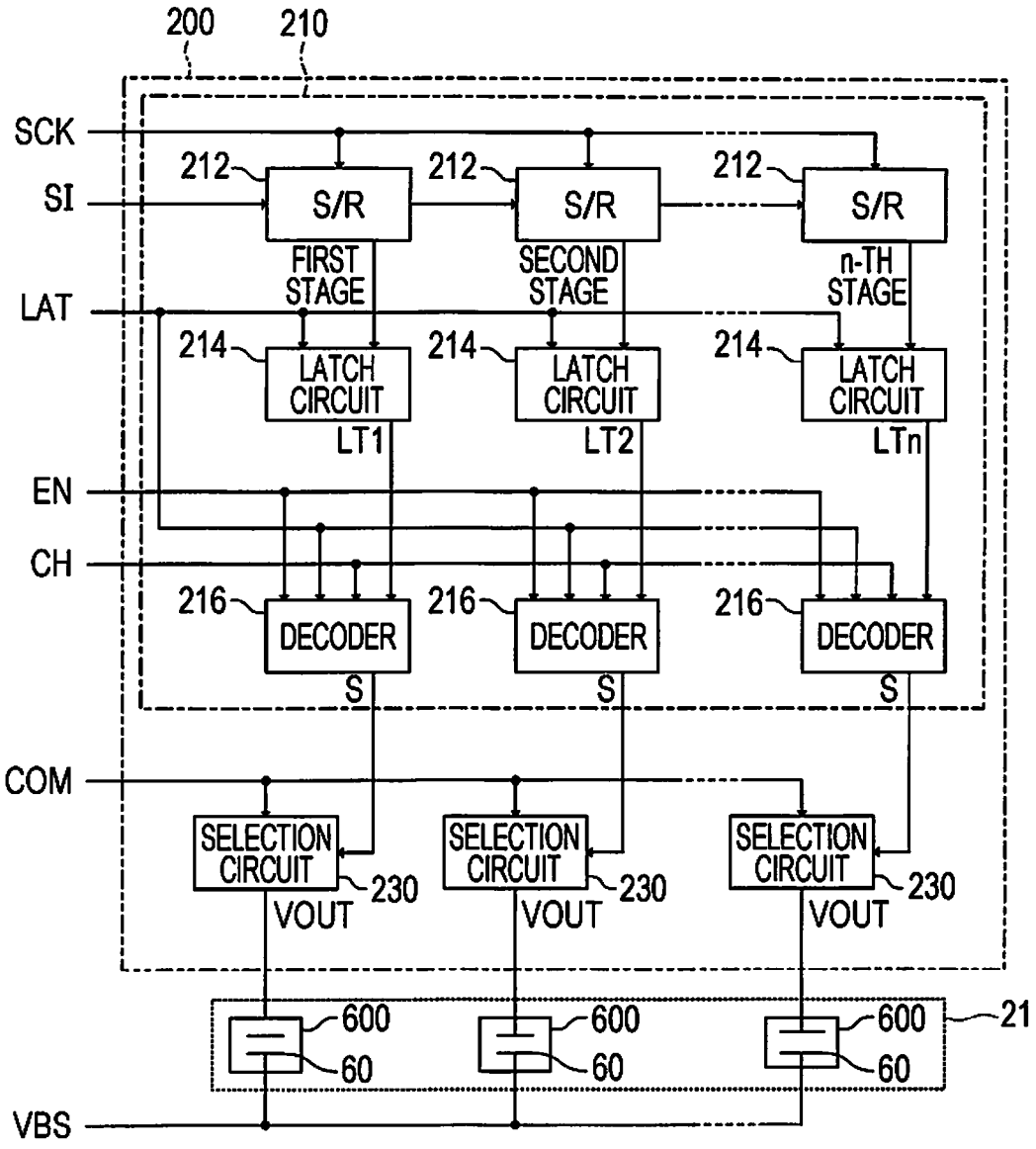
FIG. 4 is a block diagram illustrating an electric configuration of a driving signal selection circuit.

FIG. 4 is a block diagram illustrating an electric configuration of the driving signal selection circuit 200. The driving signal selection circuit 200 generates the driving signal VOUT in the period Ta by selecting or not selecting the trapezoidal waveforms Adp, Bdp, and Cdp included in the driving signal COM in the periods T1, T2, and T3, respectively, and outputs the driving signal VOUT. As illustrated in FIG. 4, the driving signal selection circuit 200 includes a selection control circuit 210 and a plurality of selection circuits 230.

The clock signal SCK, the print data signal SI, the latch signal LAT, and the change signal CH are supplied to the selection control circuit 210. In the selection control circuit 210, combinations of a shift register (S/R) 212, a latch circuit 214, and a decoder 216 are provided for the respective discharge sections 600. Specifically, the print head 20 includes a number of combinations of the shift register 212, the latch circuit 214, and the decoder 216 which correspond to a total number n of the discharge sections 600.

The shift register 212 temporarily stores print data [SIH, SIL] of two bits included in the print data signal SI for a corresponding one of the discharge sections 600. Specifically, the shift registers 212 of a number of stages corresponding to the discharge sections 600 are serially coupled to each other, and the print data signal SI serially supplied is successively transferred to the individual stages in accordance with the clock signal SCK. Note that, in FIG. 4, first to n-th stages are illustrated from an upstream of supply of the print data signal SI so as to distinguish the shift registers 212 from one another.

Each of the n latch circuits 214 latches the print data [SIH, SIL] stored in a corresponding one of the shift registers 212 at rising of the latch signal LAT. Each of the n decoders 216 generates a selection signal S by decoding the print data [SIH, SIL] of two bits which has been latched by a corresponding one of the latch circuits 214 and supplies the selection signal S to a corresponding one of the selection circuits 230.

The selection circuits 230 are disposed so as to correspond to the discharge sections 600. Specifically, the number of selection circuits 230 included in the single print head 20 is the same as the total number n of the discharge sections 600 included in the print head 20. Each of the selection circuits 230 controls supply of the signal waveform included in the driving signal COM to a corresponding one of the piezoelectric elements 60 based on the selection signal S supplied from a corresponding one of the decoders 216.

Figures 5, 6:
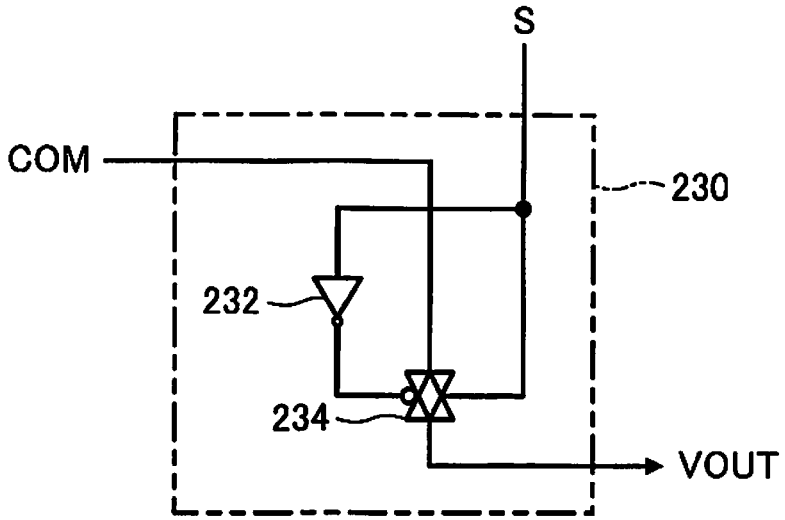
FIG. 5 is a diagram illustrating a configuration of a selection circuit.
FIG. 6 is a diagram illustrating content of decoding performed by the decoder.

FIG. 5 is a diagram illustrating a configuration of one of the selection circuits 230 corresponding to the discharge sections 600. As illustrated in FIG. 5, each of the selection circuits 230 includes an inverter 232 which is a NOT circuit and a transfer gate 234.

While being supplied to a positive control terminal of the transfer gate 234 which is not denoted by a circle, the selection signal S is logically inverted by the inverter 232 before being supplied to a negative control terminal of the transfer gate 234 which is denoted by a circle. Furthermore, the driving signal COM is supplied to an input terminal of the transfer gate 234. Then the transfer gate 234 brings a portion between the input terminal and an output terminal into a conductive state when the selection signal S is in a high level and brings the portion between the input terminal and the output terminal into a non-conductive state when the selection signal S is in a low level. By this, a driving signal VOUT is supplied from the output terminal of the transfer gate 234 to a corresponding one of the discharge sections 600.

Next, content of decoding performed by the decoder 216 will be described with reference to FIG. 6. FIG. 6 is a diagram illustrating content of decoding performed by the decoder 216. The print data [SIH, SIL] of two bits, the latch signal LAT, and the change signal CH are supplied to the decoder 216.

The decoder 216 specifies logical levels of the selection signals S output in the individual periods T1, T2, and T3 specified by the latch signal LAT and the change signal CH based on the print data (SIH, SILL For example, when the print data [SIH, SIL] is [1, 0], the decoder 216 outputs a selection signal S of a high level, a low level, and a low level in the periods T1, T2, and T3, respectively, as illustrated in FIG. 6.

Figure 7:
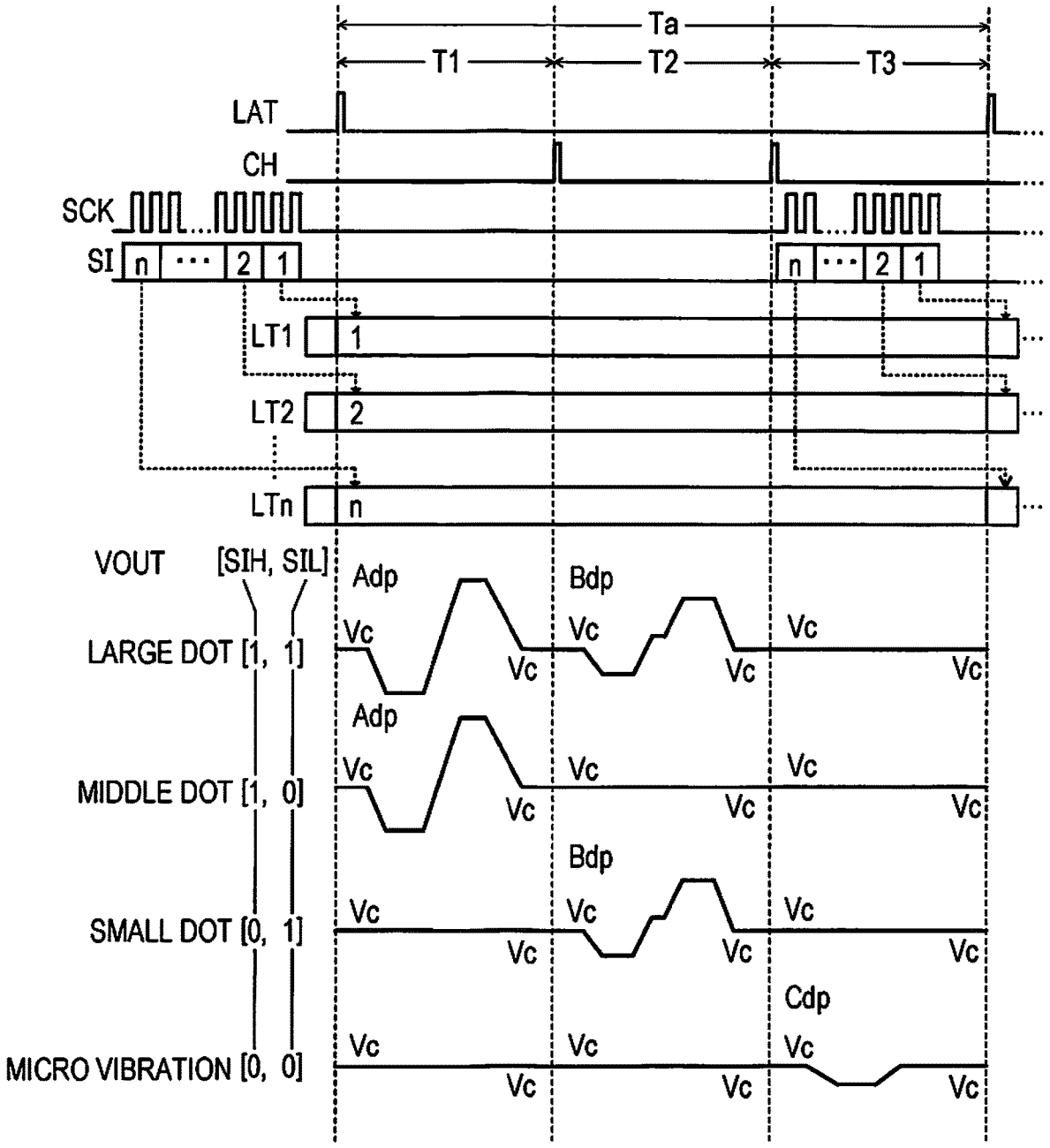
FIG. 7 is a diagram illustrating an operation of a driving signal selection circuit.

In the driving signal selection circuit 200 described above, an operation of generating the driving signal VOUT will be described in detail with reference to FIG. 7. FIG. 7 is a diagram illustrating an operation of the driving signal selection circuit 200. As illustrated in FIG. 7, the print data signal SI is serially supplied to the driving signal selection circuit 200 in synchronization with the clock signal SCK and is successively transferred by the shift registers 212 corresponding to the discharge sections 600. When the supply of the clock signal SCK is stopped, the print data [SIH, SIL] corresponding to the discharge sections 600 is stored in the individual shift registers 212. Note that the print data signal SI is supplied in order of the last n-th to first discharge sections 600 corresponding to the shift registers 212.

Here, when the latch signal LAT rises, the latch circuits 214 simultaneously latch the print data [SIH, SIL] stored in the corresponding shift registers 212. In FIG. 7, LT1 to LTn denote the print data [SIH, SIL] latched by the latch circuits 214 corresponding to the shift registers 212 in the first to n-th stages.

Each of the decoders 216 outputs a selection signal S of a logic level in accordance with the content illustrated in FIG. 6 in each of the periods T1, T2, and T3 based on the print data [SIH, SIL].

When the print data [SIH, SIL] is [1, 1], each of the selection circuits 230 selects the trapezoidal waveform Adp in the period T1, selects the trapezoidal waveform Bdp in the period T2, and does not select the trapezoidal waveform Cdp in the period T3 in accordance with the selection signal S output from a corresponding one of the decoders 216. As a result, a driving signal VOUT corresponding to a large dot is generated as illustrated in FIG. 7. Furthermore, when the print data [SIH, SIL] is [1, 0], the selection circuit 230 selects the trapezoidal waveform Adp in the period T1, does not select the trapezoidal waveform Bdp in the period T2, and does not select the trapezoidal waveform Cdp in the period T3 in accordance with the selection signal S output from the decoder 216. As a result, the driving signal VOUT corresponding to a middle dot is generated as illustrated in FIG. 7. Moreover, when the print data [SIH, SIL] is [0, 1], the selection circuit 230 does not select the trapezoidal waveform Adp in the period T1, selects the trapezoidal waveform Bdp in the period T2, and does not select the trapezoidal waveform Cdp in the period T3 in accordance with the selection signal S output from the decoder 216. As a result, the driving signal VOUT corresponding to a small dot is generated as illustrated in FIG. 7. Furthermore, when the print data [SIH, SIL] is [0, 0], the selection circuit 230 does not select the trapezoidal waveform Adp in the period T1, does not select the trapezoidal waveform Bdp in the period T2, and selects the trapezoidal waveform Cdp in the period T3 in accordance with the selection signal S output from the decoder 216. As a result, the driving signal VOUT corresponding to micro vibration is generated as illustrated in FIG. 7.

As described above, the driving signal selection circuit 200 controls discharge of ink from the nozzles. Then the driving signal selection circuit 200 selects a signal waveform of the driving signal COM based on the print data signal SI so as to generate the driving signal VOUT to be supplied to the piezoelectric elements 60. Here, the driving signal COM is an example of a driving signal. Furthermore, the driving signal VOUT generated by selecting a voltage waveform included in the driving signal COM is also an example of a driving signal in a broad sense. Furthermore, the print data signal SI which controls the supply of the driving signal COM to the piezoelectric elements 60 is an example of a discharge control signal.

3. Configuration and Operation of Discharge Section

Figure 8:
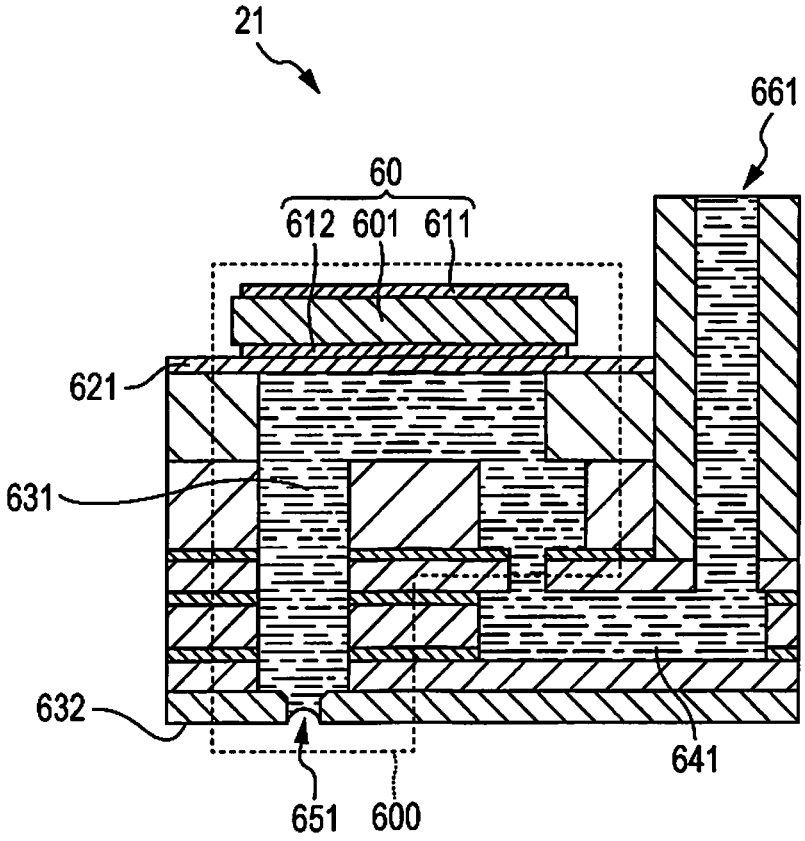
FIG. 8 is a cross-sectional view schematically illustrating a discharge section.

Next, a configuration and an operation of the discharge sections 600 included in the discharge head 21 will be described. FIG. 8 is a cross-sectional view schematically illustrating a configuration of one of the discharge sections 600 in a state in which the discharge head 21 is cut such that the discharge section 600 is included. As illustrated in FIG. 8, the discharge head 21 includes the discharge section 600 and a reservoir 641.

Ink is guided to the reservoir 641 through a supply port 661. Furthermore, the reservoir 641 is disposed for each ink color.

The discharge section 600 includes the piezoelectric element 60, a vibration plate 621, a cavity 631, and a nozzle 651. The vibration plate 621 is disposed between the cavity 631 and the piezoelectric element 60, is displaced by driving of the piezoelectric element 60 disposed on an upper surface of the vibration plate 621, and functions as a diaphragm which enlarges or reduces internal volume of the cavity 631 which is filled with ink. The nozzle 651 is an opening portion formed on a nozzle plate 632 and communicated with the cavity 631. The cavity 631 is filled with ink and functions as a pressure chamber in which internal voltage thereof is changed by displacement of the piezoelectric element 60. The nozzle 651 is communicated with the cavity 631 and discharges the ink from the cavity 631 in accordance with a change of the internal voltage of the cavity 631.

The piezoelectric element 60 is configured such that a piezoelectric body 601 is sandwiched between electrodes 611 and 612. The driving signal VOUT is supplied to the electrode 611 and the reference voltage signal VBS is supplied to the electrode 612. The piezoelectric elements 60 of such a configuration is driven by a potential difference between the electrodes 611 and 612. A center portion of the electrodes 611 and 612 and the vibration plate 621 are vertically displaced relative to opposite end portions in accordance with the driving of the piezoelectric element 60, and ink is discharged from the nozzle 651 in accordance with the displacement of the vibration plate 621. Specifically, the discharge head 21 included in the print head 20 includes the piezoelectric elements 60, each of which is driven by a potential difference between the electrode 611 which receives the driving signal VOUT and the electrode 612 which receives the reference voltage signal VBS, and discharges ink from the nozzles 651 when the piezoelectric elements 60 are driven. Here, the piezoelectric elements 60 which driven based on the driving signal VOUT and which discharge ink from the nozzles 651 by the driving are an example of the driving element.

Figure 9:
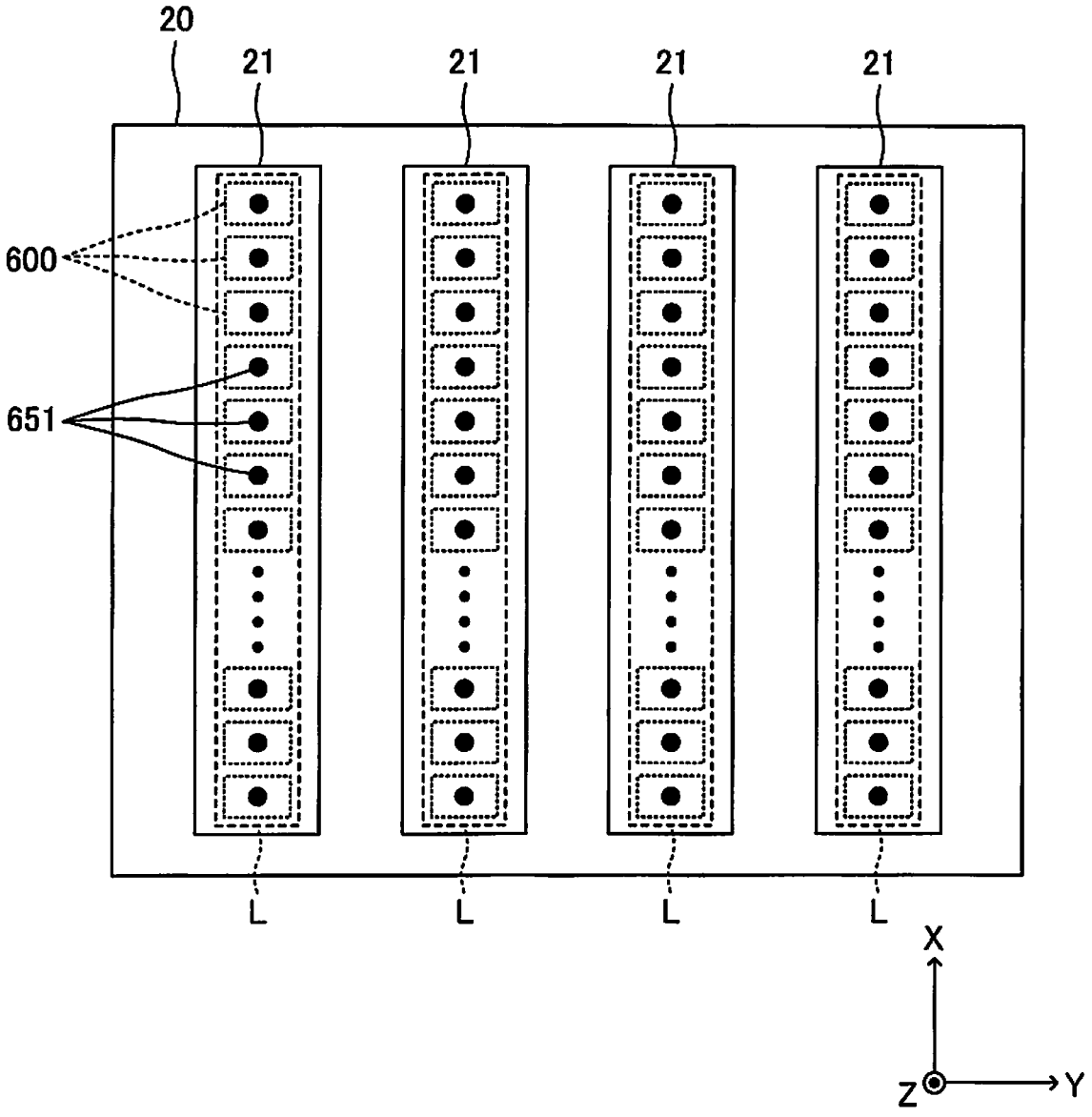
FIG. 9 is a diagram illustrating an example of arrangement of a plurality of nozzles.

FIG. 9 is a plan view of an example of arrangement of the plurality of nozzles 651 disposed on the discharge head 21 when the print apparatus 1 is viewed in the Z direction. Note that it is assumed in FIG. 9 that the print head 20 includes four discharge heads 21.

As illustrated in FIG. 9, each of the discharge heads 21 has a nozzle line L including the plurality of nozzles 651 which are aligned in a predetermined direction. Each of the nozzle lines L includes n nozzles 651 which are aligned in the X direction. Here, the nozzle lines L of FIG. 9 are merely an example and may have a different configuration. For example, the n nozzles 651 may be arranged in a zig-zag manner such that the even-numbered nozzles 651 counted from one end and the odd-numbered nozzles 651 are differently positioned in the Y direction. Furthermore, the nozzle lines L may be formed in a direction which is different from the X direction. Furthermore, each of the discharge heads 21 may have two or more nozzle lines L.

4. Configuration and Operation of Control Circuit

A configuration and an operation of the control circuit 100 included in the print head control circuit 10 will now be described with reference to FIGS. 10 to 13. As illustrated in FIGS. 10 to 13, the control circuit 100 of this embodiment includes a storage section 140, a base driving signal generation circuit 160, and a discharge control signal generation circuit 170. The storage section 140 stores print width restriction information WL1 to WL4 which specify a print available range of the print head 20. Furthermore, the base driving signal generation circuit 160 outputs the base driving signal dA which is a base of the driving signal COM. Furthermore, the discharge control signal generation circuit 170 outputs the print data signal SI, the clock signal SCK, the latch signal LAT, and the change signal CH which control supply of the driving signal COM to the piezoelectric elements 60. In the control circuit 100 configured as described above, output of at least one of the base driving signal dA and the print data signal SI is restricted based on one of the print width restriction information WL1 to WL4.

The control circuit 100 further includes a timing control circuit 150 which specifies a generation timing of at least one of the base driving signal dA and the print data signal SI based on the positional information signal PIS and a CPU 110 which outputs a print width information signal PWS including one of the print width information PW1 to PW4 which specifies the print available range of the print head 20.

Figure 10:
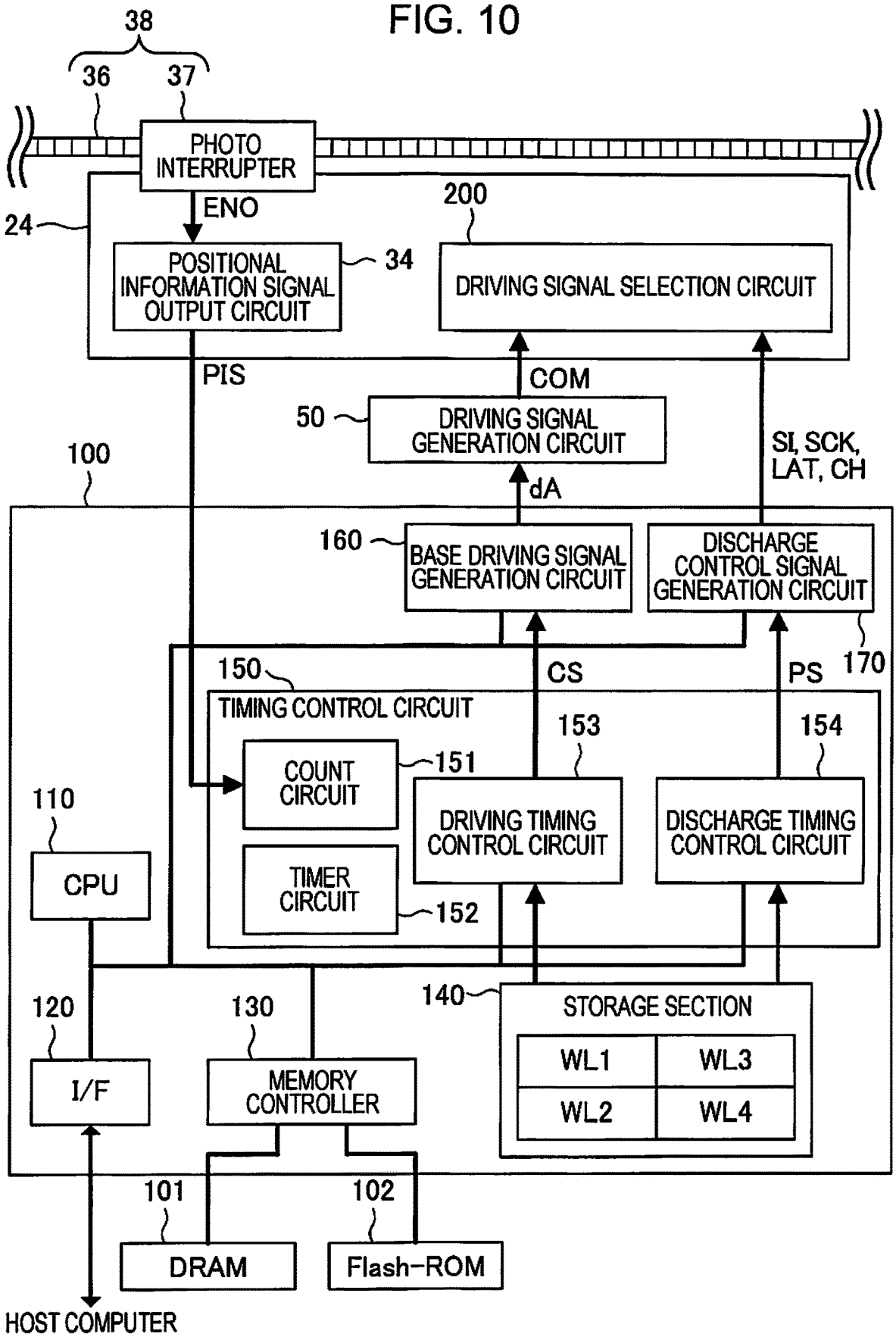
FIG. 10 is a diagram illustrating a configuration of a control circuit.

Hereinafter, a detailed description will be made with reference to the drawings. FIG. 10 is a diagram illustrating the configuration of the control circuit 100. As illustrated in FIG. 10, the control circuit 100 includes the CPU 110, a connection interface circuit (I/F) 120, a memory controller 130, the storage section 140, the timing control circuit 150, the base driving signal generation circuit 160, and the discharge control signal generation circuit 170.

When power is supplied to the print apparatus 1, the memory controller 130 reads a control program stored in a flash-ROM 102. The CPU 110 starts a calculation process based on the read control program. When the CPU 110 executes the calculation process based on the control program, the control program is stored in a DRAM 101. Then the CPU 110 executes the calculation process based on the control program stored in the DRAM 101. By this, the CPU 110 may perform the calculation process at high speed. Furthermore, image data is supplied from the host computer through the connection interface circuit 120. Then the CPU 110 controls the various components of the control circuit 100 based on the input image data. Here, the CPU 110 is an example of a calculation processing circuit.

The CPU 110 controls the operation of the base driving signal generation circuit 160 based on the input image data. The base driving signal generation circuit 160 generates the base driving signal dA to be a base of the driving signal COM based on the calculation process performed by the CPU 110 and a base driving control signal CS supplied from the timing control circuit 150.

Furthermore, the CPU 110 controls the operation of the discharge control signal generation circuit 170 based on the input image data. The discharge control signal generation circuit 170 outputs the print data signal SI, the clock signal SCK, the latch signal LAT, and the change signal CH used to control supply of the driving signal COM to the piezoelectric elements 60 based on the calculation process performed by the CPU 110 and a discharge restriction signal PS supplied from the timing control circuit 150.

Furthermore, the CPU 110 generates the print width information PW1 to PW4 which specify the print available range of the print head 20 based on the input image data and outputs a print width information signal PWS including the print width information PW1 to PW4 to the timing control circuit 150. Here, the print width information PW1 to PW4 generated by the CPU 110 may be information based on a size of the medium P specified based on the input image data, for example, or may be information generated in accordance with various state information of the print head 20, such as temperature information of the print head 20, and a size of the medium P.

The storage section 140 stores print width restriction information WL1 to WL4 which specify a print available range of the print head 20. The print width restriction information WL1 to WL4 stored in the storage section 140 is supplied to the timing control circuit 150. Here, the storage section 140 is an example of a memory circuit.

Furthermore, the positional information signal PIS is supplied to the timing control circuit 150. The positional information signal PIS is generated by the positional information signal output circuit 34 based on an encoder output signal ENO output from an encoder 38 which detects a position of the carriage 24.

Specifically, the encoder 38 includes a linear scale 36 and a photo interrupter 37. The linear scale 36 is disposed along the carriage guide shaft 32 illustrated in FIG. 1. Then the linear scale 36 has a plurality of slits formed along the carriage guide shaft 32 at regular intervals. The photo interrupter 37 includes a light emitting section and a light receiving section, not illustrated, and is disposed in the carriage 24. The light emitting section and the light receiving section of the photo interrupter 37 sandwich the linear scale 36. Specifically, the light emitting section and the light receiving section are disposed such that light emitted from the light emitting section is receivable by the light receiving section through the slits arranged in parallel on the linear scale 36. Then the photo interrupter 37 outputs a pulse signal generated in accordance with presence or absence of light input to the light receiving section as the encoder output signal ENO.

The encoder 38 configured as described above receives light of a pulse shape by the light receiving section through the slits formed at regular intervals when the carriage 24 is moved. Accordingly, when the carriage 24 is moved, the photo interrupter 37 outputs the encoder output signal ENO of a pulse signal.

The positional information signal output circuit 34 corrects and amplifies a pulse signal based on the encoder output signal ENO so as to generate the positional information signal PIS of the pulse signal to be output. Specifically, the number of pulses of the pulse signal included in the positional information signal PIS corresponds to positional information PI of the carriage 24 and the print head 20.

The timing control circuit 150 includes a count circuit 151, a timer circuit 152, a driving timing control circuit 153, and a discharge timing control circuit 154. Then the timing control circuit 150 specifies a generation timing of at least one of the base driving signal dA and the print data signal SI based on the print width restriction information WL1 to WL4 supplied from the storage section 140, the print width information PW1 to PW4 supplied from the CPU 110, and the positional information signal PIS supplied from the positional information signal output circuit 34.

Specifically, the count circuit 151 counts the number of pulses of the positional information signal PIS. By this, positional information in accordance with reciprocation of the carriage 24 and the print head 20 may be obtained. Then the driving timing control circuit 153 generates and outputs the base driving control signal CS based on a result of a determination as to whether the number of pulses of the positional information signal PIS is within a range specified by the print width restriction information WL1 and WL2 and the print width information PW1 and PW2. Specifically, the driving timing control circuit 153 specifies a timing when the base driving signal dA is generated. Furthermore, the discharge timing control circuit 154 generates and outputs the discharge restriction signal PS based on a result of a determination as to whether the number of pulses of the positional information signal PIS is within a range specified by the print width restriction information WL3 and WL4 and the print width information PW3 and PW4. Specifically, the discharge timing control circuit 154 specifies a timing when the print data signal SI is generated.

The timer circuit 152 measures a period of time in which the positional information signal PIS is not supplied to the count circuit 151. Then the timer circuit 152 resets the count value of the count circuit 151 when the positional information signal PIS is not supplied to the count circuit 151 for a predetermined period of time since the carriage 24 is stopped in a predetermined position or a direction of the carriage 24 is to be changed for reciprocation.

Figure 11:
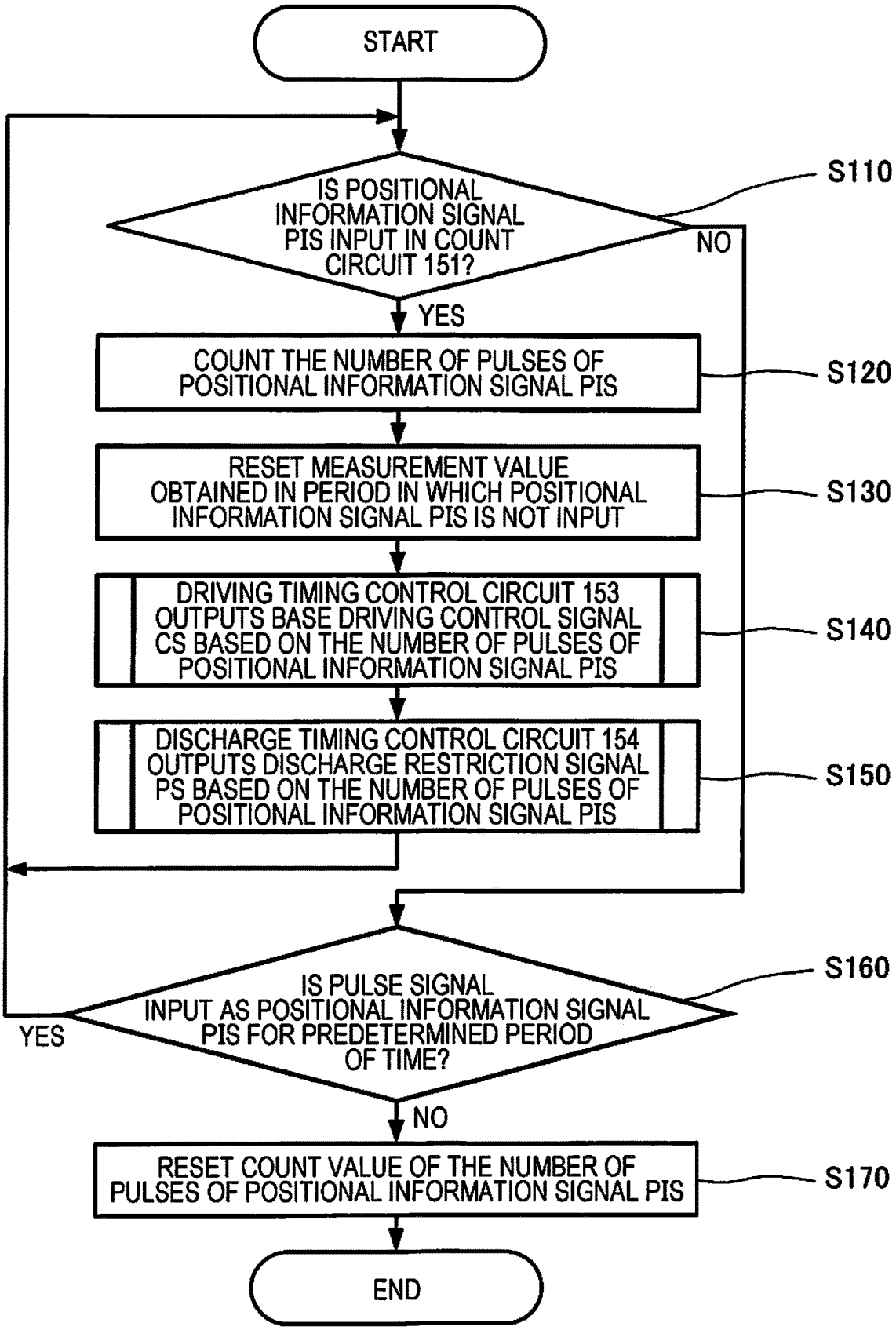
FIG. 11 is a flowchart of an operation of a timing control circuit.
Figure 12:
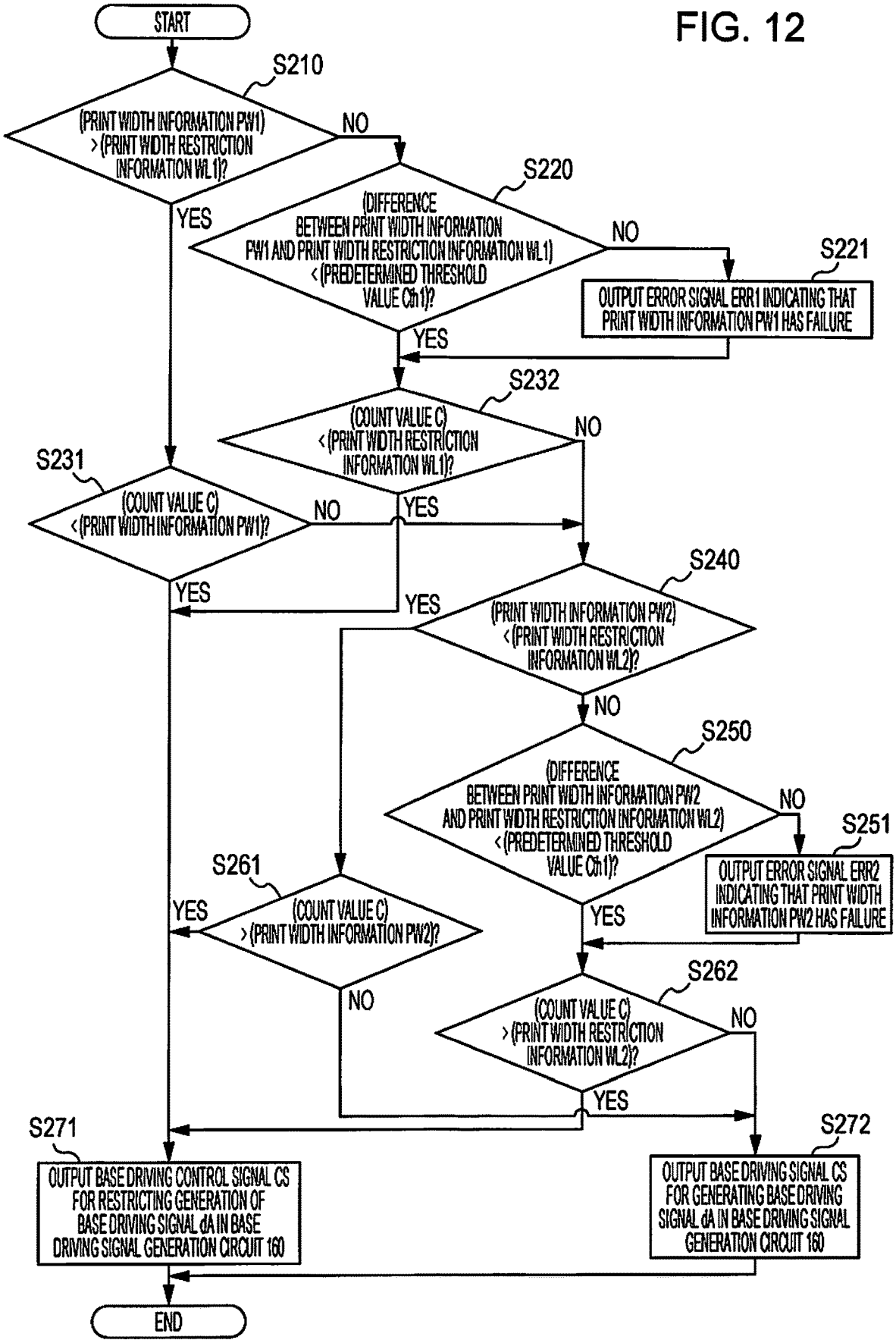
FIG. 12 is a flowchart of an operation of a driving timing control circuit.
Figure 13:
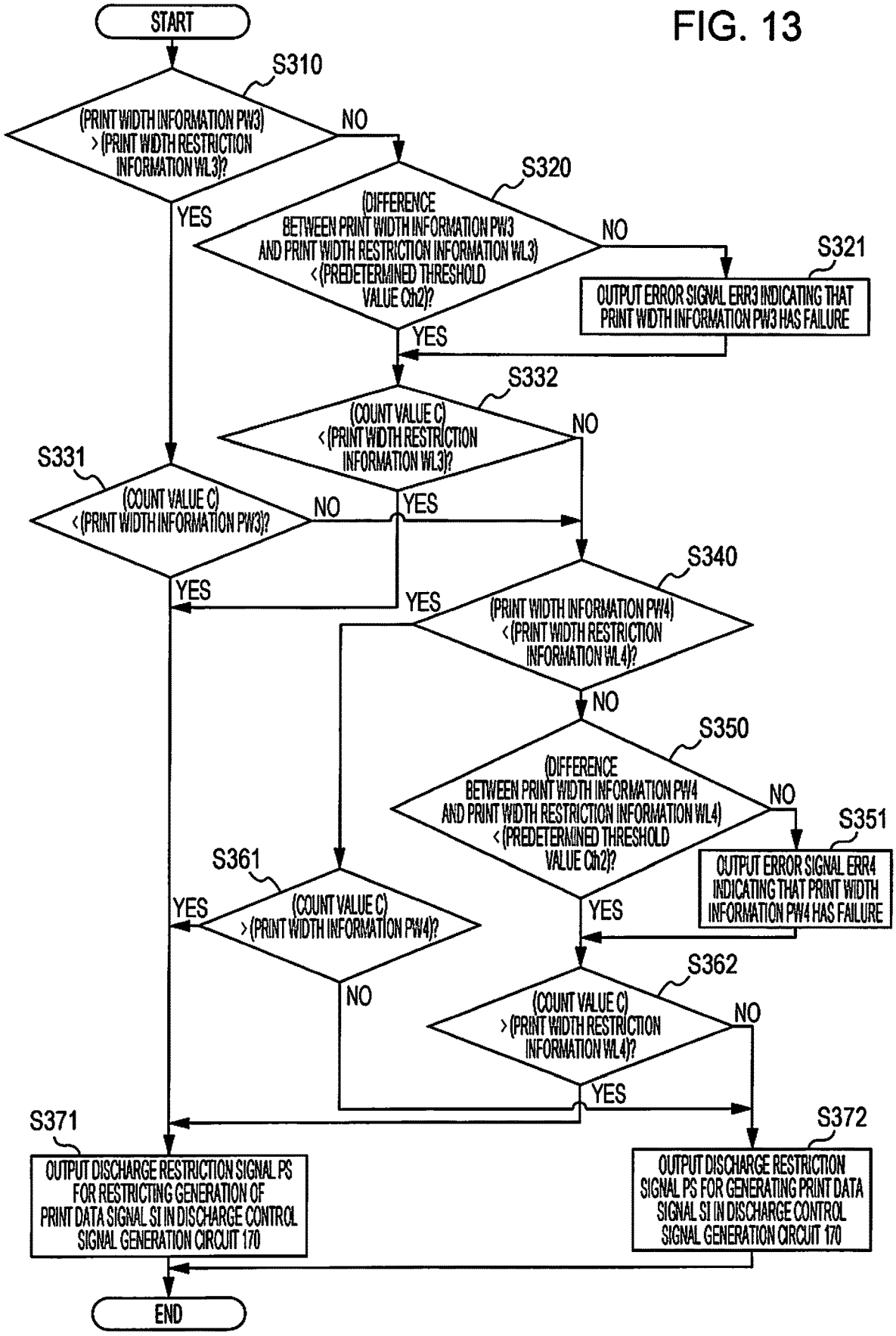
FIG. 13 is a flowchart of an operation of a discharge timing control circuit.

Here, an operation of the timing control circuit 150 will be described with reference to FIGS. 11 to 13. FIG. 11 is a flowchart of an operation of the timing control circuit 150. FIG. 12 is a flowchart of an operation of the driving timing control circuit 153. FIG. 13 is a flowchart of an operation of the discharge timing control circuit 154.

As illustrated in FIG. 11, the timing control circuit 150 determines whether the positional information signal PIS of the pulse signal has been supplied to the count circuit 151 (step S110). When the timing control circuit 150 determines that the positional information signal PIS of the pulse signal has been supplied to the count circuit 151 (Yes in step S110), the count circuit 151 counts the number of pulses included in the pulse signal of the positional information signal PIS (step S120). Thereafter, the timer circuit 152 resets a measurement value in the period of time in which the positional information signal PIS is not supplied (step S130). Here, the timing control circuit 150 may determine whether the positional information signal PIS of the pulse signal has been supplied by a detection of at least one of a rising edge and a falling edge of the positional information signal PIS performed by the count circuit 151, for example.

Then the driving timing control circuit 153 outputs the base driving control signal CS in accordance with the number of pulses of the positional information signal PIS (step S140), and the discharge timing control circuit 154 outputs the discharge restriction signal PS in accordance with the number of pulses of the positional information signal PIS (step S150). Note that the process in step S130, step S140, and step S150 may be executed in order different from that of FIG. 11 or may be simultaneously executed. After the driving timing control circuit 153 and the discharge timing control circuit 154 output the base driving control signal CS and the discharge restriction signal PS, respectively, the timing control circuit 150 determines whether the positional information signal PIS of the pulse signal has been supplied to the count circuit 151 (step S110).

When the positional information signal PIS of the pulse signal has not been supplied to the count circuit 151 (No in step S110), the timer circuit 152 measures a period of time in which the positional information signal PIS is not supplied to the count circuit 151. Thereafter, the timer circuit 152 determines whether a pulse signal serving as the positional information signal PIS has been supplied for a predetermined period of time (step S160). When the timer circuit 152 determines that a pulse signal serving as the positional information signal PIS has not been supplied for a predetermined period of time (No in step S160), the count circuit 151 resets the count value of the number of pulses in the positional information signal PIS (step S170). When the timer circuit 152 determines that a period in which a pulse signal serving as the positional information signal PIS has not been supplied does not exceed a predetermined period of time (Yes in step S160), the timing control circuit 150 determines whether the positional information signal PIS of the pulse signal has been supplied to the count circuit 151 (step S110).

Next, an operation of the driving timing control circuit 153 will be described with reference to FIG. 12. The driving timing control circuit 153 operates based on the print width information PW1 and PW2 included in the print width information PW1 to PW4 supplied to the timing control circuit 150, the print width restriction information WL1 and WL2 included in the print width restriction information WL1 to WL4, the count value C which is based on the positional information signal PIS and which is counted by the count circuit 151.

The driving timing control circuit 153 determines whether the print width information PW1 is larger than the print width restriction information WL1 (step S210). When the print width information PW1 is larger than the print width restriction information WL1 (Yes in step S210), the driving timing control circuit 153 determines whether the count value C is smaller than the print width information PW1 (step S231). When the count value C is smaller than the print width information PW1 (Yes in step S231), the driving timing control circuit 153 outputs the base driving control signal CS which restricts generation of the base driving signal dA performed by the base driving signal generation circuit 160 (step S271).

When the print width information PW1 is equal to or smaller than the print width restriction information WL1 (No in step S210), the driving timing control circuit 153 determines whether a difference between the print width information PW1 and the print width restriction information WL1 is smaller than a predetermined threshold value Cth1 (step S220). When a difference between the print width information PW1 and the print width restriction information WL1 is smaller than a predetermined threshold value Cth1 (Yes in step S220), the driving timing control circuit 153 determines whether the count value C is smaller than the print width restriction information WL1 (step S232).

On the other hand, when a difference between the print width information PW1 and the print width restriction information WL1 is equal to or larger than a predetermined threshold value Cth1 (No in step S220), the driving timing control circuit 153 outputs an error signal ERR1 indicating that the print width information PW1 has an error to the CPU 110 (step S221), and thereafter, determines whether the count value C is smaller than the print width restriction information WL1 (step S232). Specifically, the driving timing control circuit 153 included in the timing control circuit 150 outputs the error signal ERR1 indicating that the print width information PW1 has an error when a difference between a value specified by the print width restriction information WL1 and a value specified by the print width information PW1 is equal to or larger than a predetermined threshold value Cth1.

When the count value C is smaller than the print width restriction information WL1 (Yes in step S232), the driving timing control circuit 153 outputs the base driving control signal CS which restricts generation of the base driving signal dA performed by the base driving signal generation circuit 160 (step S271).

When the count value C is equal to or larger than the print width information PW1 (No in step S231) or when the count value C is equal to or larger than the print width restriction information WL1 (No in step S232), the driving timing control circuit 153 determines whether the print width information PW2 is smaller than the print width restriction information WL2 (step S240). When the print width information PW2 is smaller than the print width restriction information WL2 (Yes in step S240), the driving timing control circuit 153 determines whether the count value C is larger than the print width information PW2 (step S261). When the count value C is larger than the print width information PW2 (Yes in step S261), the driving timing control circuit 153 outputs the base driving control signal CS which restricts generation of the base driving signal dA performed by the base driving signal generation circuit 160 (step S271).

When the print width information PW2 is equal to or larger than the print width restriction information WL2 (No in step S240), the driving timing control circuit 153 determines whether a difference between the print width information PW2 and the print width restriction information WL2 is smaller than the predetermined threshold value Cth1 (step S250). When a difference between the print width information PW2 and the print width restriction information WL2 is smaller than the predetermined threshold value Cth1 (Yes in step S250), the driving timing control circuit 153 determines whether the count value C is larger than the print width restriction information WL2 (step S262).

On the other hand, when a difference between the print width information PW2 and the print width restriction information WL2 is equal to or larger than the predetermined threshold value Cth1 (No in step S250), the driving timing control circuit 153 outputs an error signal ERR2 indicating that the print width information PW2 has an error to the CPU 110 (step S251), and thereafter, determines whether the count value C is larger than the print width restriction information WL2 (step S262). Specifically, the driving timing control circuit 153 included in the timing control circuit 150 outputs the error signal ERR2 indicating that the print width information PW2 has an error when a difference between a value specified by the print width restriction information WL2 and a value specified by the print width information PW2 is equal to or larger than the predetermined threshold value Cth1.

When the count value C is larger than the print width restriction information WL2 (Yes in step S262), the driving timing control circuit 153 outputs the base driving control signal CS which restricts generation of the base driving signal dA performed by the base driving signal generation circuit 160 (step S271).

When the count value C is equal to or smaller than the print width information PW2 (No in step S261) or when the count value C is equal to or smaller than the print width restriction information WL2 (No in step S262), the driving timing control circuit 153 outputs the base driving control signal CS for generating the base driving signal dA in the base driving signal generation circuit 160 (step S272).

As described above, the driving timing control circuit 153 restricts output of the base driving signal dA based on the print width restriction information WL1 and WL2, the print width information PW1 and PW2, and the positional information signal PIS.

Next, an operation of the discharge timing control circuit 154 will be described with reference to FIG. 13. The discharge timing control circuit 154 operates based on the print width information PW3 and PW4 among the print width information PW1 to PW4 supplied to the timing control circuit 150, the print width restriction information WL3 and WL4 among the print width restriction information WL1 to WL4, the count value C which is based on the positional information signal PIS and which is counted by the count circuit 151.

The discharge timing control circuit 154 determines whether the print width information PW3 is larger than the print width restriction information WL3 (step S310). When the print width information PW3 is larger than the print width restriction information WL3 (Yes in step S310), the discharge timing control circuit 154 determines whether the count value C is smaller than the print width information PW3 (step S331). When the count value C is smaller than the print width information PW3 (Yes in step S331), the discharge timing control circuit 154 outputs the discharge restriction signal PS which restricts generation of the print data signal SI performed by the discharge control signal generation circuit 170 (step S371).

When the print width information PW3 is equal to or smaller than the print width restriction information WL3 (No in step S310), the discharge timing control circuit 154 determines whether a difference between the print width information PW3 and the print width restriction information WL3 is smaller than a predetermined threshold value Cth2 (step S320). When a difference between the print width information PW3 and the print width restriction information WL3 is smaller than a predetermined threshold value Cth2 (Yes in step S320), the discharge timing control circuit 154 determines whether the count value C is smaller than the print width restriction information WL3 (step S332).

On the other hand, when a difference between the print width information PW3 and the print width restriction information WL3 is equal to or larger than a predetermined threshold value Cth2 (No in step S320), the discharge timing control circuit 154 outputs an error signal ERR3 indicating that the print width information PW3 has an error to the CPU 110 (step S321), and thereafter, determines whether the count value C is smaller than the print width restriction information WL3 (step S332). Specifically, the discharge timing control circuit 154 included in the timing control circuit 150 outputs the error signal ERR3 indicating that the print width information PW3 has an error when a difference between a value specified by the print width restriction information WL3 and a value specified by the print width information PW3 is equal to or larger than the predetermined threshold value Cth2.

When the count value C is smaller than the print width restriction information WL3 (Yes in step S332), the discharge timing control circuit 154 outputs the discharge restriction signal PS which restricts generation of the print data SI in the discharge control signal generation circuit 170 (step S371).

When the count value C is equal to or larger than the print width information PW3 (No in step S331) or when the count value C is equal to or larger than the print width restriction information WL3 (No in step S332), the discharge timing control circuit 154 determines whether the print width information PW4 is smaller than the print width restriction information WL4 (step S340). When the print width information PW4 is smaller than the print width restriction information WL4 (Yes in step S340), the discharge timing control circuit 154 determines whether the count value C is larger than the print width information PW4 (step S361). When the count value C is larger than the print width information PW4 (Yes in step S361), the discharge timing control circuit 154 outputs the discharge restriction signal PS which restricts generation of the print data signal SI performed by the discharge control signal generation circuit 170 (step S371).

When the print width information PW4 is equal to or larger than the print width restriction information WL4 (No in step S340), the discharge timing control circuit 154 determines whether a difference between the print width information PW4 and the print width restriction information WL4 is smaller than the predetermined threshold value Cth2 (step S350). When a difference between the print width information PW4 and the print width restriction information WL4 is smaller than the predetermined threshold value Cth2 (Yes in step S350), the discharge timing control circuit 154 determines whether the count value C is larger than the print width restriction information WL4 (step S362).

On the other hand, when a difference between the print width information PW4 and the print width restriction information WL4 is equal to or larger than the predetermined threshold value Cth2 (No in step S350), the discharge timing control circuit 154 outputs an error signal ERR4 indicating that the print width information PW4 has an error to the CPU 110 (step S351), and thereafter, determines whether the count value C is larger than the print width restriction information WL4 (step S362). Specifically, the discharge timing control circuit 154 included in the timing control circuit 150 outputs the error signal ERR4 indicating that the print width information PW4 has an error when a difference between a value specified by the print width restriction information WL4 and a value specified by the print width information PW4 is equal to or larger than the predetermined threshold value Cth2.

When the count value C is larger than the print width restriction information WL4 (Yes in step S362), the discharge timing control circuit 154 outputs the discharge restriction signal PS which restricts generation of the print data SI in the discharge control signal generation circuit 170 (step S371).

When the count value C is equal to or smaller than the print width information PW4 (No in step S361) or when the count value C is equal to or smaller than the print width restriction information WL4 (No in step S362), the discharge timing control circuit 154 outputs the discharge restriction signal PS for generating the print data signal SI in the discharge control signal generation circuit 170 (step S372).

As described above, the discharge timing control circuit 154 restricts output of the print data signal SI based on the print width restriction information WL3 and WL4, the print width information PW3 and PW4, and the positional information signal PIS.

As described above, according to the print apparatus 1 of this embodiment, the base driving signal generation circuit 160 included in the control circuit 100 generates the base driving signal dA in a region which is between the print width restriction information WL1 and the print width restriction information WL2 and which is between the print width information PW1 and the print width information PW2, and the discharge control signal generation circuit 170 included in the control circuit 100 generates the print data signal SI in a region which is between the print width restriction information WL3 and the print width restriction information WL4 and which is between the print width information PW3 and the print width information PW4. Specifically, a print available range of the print head 20 which discharges ink from the nozzle 651 is controlled by the control circuit 100 disposed on the print head control circuit 10 which controls the print head 20. By this, when ink discharge restriction occurs in the nozzles 651, the driving signal COM and the print data signal SI are not continuously supplied to the print head 20. Accordingly, reduction of power consumption of the print apparatus 1 is realized and reduction of heat generation in the print head 20 may be realized.

Furthermore, discharge of ink from the nozzles included in the print head 20 is restricted based on the print width restriction information WL1 to WL4 stored in the control circuit 100 of the print head control circuit 10, and therefore, even in a print apparatus 1 which is available for a different size of medium P, the print head 20 and the control circuit 100 may be used only by changing the print width restriction information WL1 to WL4.

Here, in the discharge control signal generation circuit 170, the region between the print width restriction information WL3 and the print width restriction information WL4 where the print data signal SI may be generated is preferably set in the region in the base driving signal generation circuit 160 between the print width restriction information WL1 and the print width restriction information WL2 where the base driving signal dA may be generated. When the supply of the print data signal SI is restricted, the discharge control signal generation circuit 170 outputs a signal of a low level. Specifically, print data [SIH, SIL] included in the print data signal SI is [0, 0]. Therefore, the discharge section 600 generates micro vibration in a region which is outside the region between the print width restriction information WL3 and the print width restriction information WL4 where the print data signal SI may be generated and which is between the print width restriction information WL1 and the print width restriction information WL2 where the base driving signal dA may be generated. By this, the possibility that viscosity of ink in the vicinity of the nozzles 651 is increased may be suppressed.

5. Operations and Effects

As described above, the control circuit 100 which is an integrated circuit apparatus used in the print apparatus 1 according to this embodiment restricts output of at least one of the base driving signal dA which is a base on the driving signal COM and the print data signal SI based on the print width restriction information WL1 to WL4 stored in the control circuit 100. Therefore, in a case where a print width of discharge of ink is restricted in the print apparatus 1, supply of at least one of the driving signal COM and the print data signal SI to the print head is controlled. Accordingly, power consumption and heat generation in the print head 20 in a case of discharge restriction in the print head 20 may be reduced.

Furthermore, in the print apparatus 1 of this embodiment, the control circuit 100 restricts the print width of the print head 20. Therefore, even in a print apparatus 1 using media of a different size, a print width may be individually restricted using the common print head 20 by setting the print width restriction information WL1 to WL4 of the control circuit 100. Accordingly, specifications of an integrated circuit apparatus and a print head 20 included in the control circuit 100 may be standardized.

Furthermore, in the print apparatus 1 of this embodiment, if differences between the print width restriction information WL1 to WL4 stored in the storage section 140 and the print width information PW1 to PW4 generated by the CPU 110 are equal to or larger than a predetermined value, respectively, the timing control circuit 150 outputs the error signals ERR1 to ERR4 indicating that the print width information PW1 to PW4 generated by the CPU 110 have an error to the CPU 110. By this, the CPU 110 may recognize that the calculation operation has malfunction. Accordingly, the CPU 110 may perform a restoring process based on the error signals ERR1 to ERR4.

Furthermore, in the print apparatus 1 of this embodiment, the control circuit 100 may restrict printing in a range out of the range specified by the print width restriction information WL1 to WL4 stored in the storage section 140 irrespective of the print width information PW1 to PW4 generated by the CPU 110. Therefore, even if an error, such as runaway, occurs in the CPU 110 and therefore inappropriate print width information PW1 to PW4 are set in the driving timing control circuit 153 and the discharge timing control circuit 154, a print width of the print head 20 may be restricted based on the print width restriction information WL1 to WL4. Accordingly, even when an error occurs in the CPU 110, power consumption and heat generation in the print head 20 in a case where ink discharge is restricted may be reduced.

Although the embodiment and the modifications have been described hereinabove, the present disclosure is not limited to the embodiment and the modifications and may be embodied in various modes without departing from the scope of the present disclosure. For example, the embodiment and the modifications may be appropriately combined.

The present disclosure includes configurations which are substantially the same as the configurations described in the foregoing embodiment (for example, configurations having the same functions, the same methods, and the same conclusions or configurations having the same purposes and the same effects). Furthermore, the present disclosure includes configurations in which inessential portions of the configurations described above are modified. Moreover, the present disclosure includes configurations which attain the same function effects as the configurations described in the foregoing embodiment or configurations which attain the same purposes. Furthermore, the present disclosure includes configurations in which general techniques are added to the configurations described in the foregoing embodiment.

What is claimed is:

1. An integrated circuit apparatus used in a liquid discharge apparatus including a print head which reciprocates in a main scanning direction and which discharges liquid when a driving element is driven based on a driving signal and a positional information signal output circuit which outputs a positional information signal indicating positional information of the print head, the integrated circuit apparatus comprising:

a memory circuit configured to store print width restriction information which specifies a print available range of the print head;

a base driving signal generation circuit configured to output a base driving signal which is a base of the driving signal;

a discharge control signal generation circuit configured to output a discharge control signal which controls supply of the driving signal to the driving element; and a timing control circuit configured to specify a generation timing of at least one of the base driving signal and the discharge control signal based on the positional information signal, wherein the timing control circuit restricts output of at least one of the base driving signal and the discharge control signal based on the print width restriction information and the positional information signal.

2. The integrated circuit apparatus according to claim 1, further comprising:

a calculation processing circuit, wherein the calculation processing circuit outputs a print width information signal including print width information which specifies a print available range of the print head, the timing control circuit restricts output of at least one of the base driving signal and the discharge control signal based on the print width restriction information, the print width information, and the positional information signal.

3. The integrated circuit apparatus according to claim 2, wherein the timing control circuit outputs an error signal indicating that the print width information has an error when a difference between a value specified by the print width restriction information and a value specified by the print width information is not less than a predetermined value.

4. The integrated circuit apparatus according to claim 1, wherein the timing control circuit includes a driving timing control circuit which specifies a generation timing of the base driving signal, and the driving timing control circuit restricts output of the base driving signal based on the print width restriction information and the positional information signal.

5. The integrated circuit apparatus according to claim 1, wherein the timing control circuit includes a discharge timing control circuit which specifies a generation timing of the discharge control signal, and the discharge timing control circuit restricts output of the discharge control signal based on the print width restriction information and the positional information signal.

6. A liquid discharge apparatus comprising:

a print head configured to reciprocate in a main scanning direction and discharge liquid when a driving element is driven based on a driving signal;

a positional information signal output circuit configured to output a positional information signal indicating positional information of the print head; and an integrated circuit apparatus including a memory circuit configured to store print width restriction information which specifies a print available range of the print head, a base driving signal generation circuit configured to output a base driving signal which is a base of the driving signal, a discharge control signal generation circuit configured to output a discharge control signal which controls supply of the driving signal to the driving element, and a timing control circuit configured to specify a generation timing of at least one of the base driving signal and the discharge control signal based on the positional information signal, wherein the timing control circuit restricts output of at least one of the base driving signal and the discharge control signal based on the print width restriction information and the positional information signal.

* * * * *